US007628480B2

(12) United States Patent
Takatsuka

(10) Patent No.: US 7,628,480 B2
(45) Date of Patent: Dec. 8, 2009

(54) INK TANK, INK-JET RECORDING APPARATUS AND METHOD OF MANUFACTURING INK TANK

(75) Inventor: Tsutomu Takatsuka, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 427 days.

(21) Appl. No.: 11/391,198

(22) Filed: Mar. 29, 2006

(65) Prior Publication Data

US 2006/0221154 A1 Oct. 5, 2006

(30) Foreign Application Priority Data

Mar. 30, 2005 (JP) ..... 2005-099471

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS 4,593,835 A * 6/1986 Kikkawa et al. ..... 222/131
5,997,121 A * 12/1999 Altfather et al. ..... 347/7
6,058,984 A * 5/2000 Sato ..... 141/7
6,345,889 B1 * 2/2002 Sakuraoka et al. ..... 347/86
6,588,952 B1 * 7/2003 Silverbrook et al. ... 400/124.11
7,226,153 B2 * 6/2007 Sasaki ..... 347/86
7,273,273 B2 * 9/2007 Calvini et al. ..... 347/86
7,278,718 B2 * 10/2007 Aruga et al. ..... 347/85
7,344,234 B2 * 3/2008 Merz et al. ..... 347/87
7,396,114 B2 * 7/2008 Ishizawa et al. ..... 347/86

FOREIGN PATENT DOCUMENTS

JP 2000-033715 A 2/2000

* cited by examiner

*Primary Examiner*—Anh T. N. Vo
(74) *Attorney, Agent, or Firm*—Birch, Stewart, Kolasch & Birch, LLP

(57) ABSTRACT

An ink tank consists of a case body and a top lid. The case body consists of an inner case having an ink chamber and an outer case. The ink chamber is parted into an absorbent chamber containing ink absorbents, and a storage chamber storing ink. A space is provided as a heat insulating layer between the inner case and the outer case, for insulating the ink from heat energy radiated from a recording head. When manufacturing the ink tank, the absorbent chamber containing the ink absorbents is filled with the ink and the inner case is placed in the outer case. Thereafter, the top lid is attached to the case body in a vacuum, and the ink is injected in the storage chamber through ink injection holes formed through the top lid.

3 Claims, 8 Drawing Sheets

INK TANK, INK-JET RECORDING APPARATUS AND METHOD OF MANUFACTURING INK TANK

FIELD OF THE INVENTION

The present invention relates to an ink tank containing ink to be supplied to an ink-jet type recording head, an ink-jet recording apparatus using the ink tank, and a method of manufacturing the ink tank.

BACKGROUND OF THE INVENTION

An ink-jet recording apparatus has been known, which has a recording head for discharging ink as droplets onto recording paper to print an image thereon. The ink-jet recording apparatus is provided with at least an ink tank containing ink, to supply the ink from the ink tank to the recording head through an ink supply path. In an exemplar of the ink-jet recording apparatus, as disclosed for example in Japanese Laid-open Patent Application No. 2000-33715, the ink tank is placed above a head unit that consists of a recording head and other components.

The recording head is provided with a number of nozzles, pressure rooms and oscillation plates. The oscillation plates are disposed in correspondence with the respective pressure rooms, and are driven individually by piezoelectric elements. The oscillation of the oscillation plate causes a change in volume of the corresponding pressure room, which lets the nozzle discharge the ink droplets.

A problem in the conventional ink tank is that heat energy is generated from driving members of the recording head, like the piezoelectric elements, and the heat energy can heat the ink contained in the ink tank. With an increase in temperature of the ink, viscosity of the ink changes, which has a bad effect on discharging properties. Besides, the heated ink evaporates wastefully. This problem is not ignorable especially when the ink tank is attached to a line recording head which records a line of image at a time by discharging the ink from many nozzles. Because of the many nozzles, the line recording head generates much heat energy.

SUMMARY OF THE INVENTION

In view of the foregoing, a primary object of the present invention is to provide an ink tank that hinders the heat energy generated from the recording head from affecting the temperature of the ink contained in the ink tank.

Another object of the present invention is to provide an ink-jet recording apparatus for use with the ink tank.

A further object of the present invention is to provide a method of manufacturing the ink tank.

According to the present invention, an ink tank for supplying ink to an ink jet type recording head comprises a case body having an ink chamber containing the ink, the ink chamber having an ink outlet formed on its bottom portion, for letting the ink out of the ink chamber; and a heat insulating layer provided around the ink chamber in the case body, for insulating the ink chamber from external heat.

According to a preferred embodiment, the case body comprises an inner case having the ink chamber formed therein, and an outer case holding the inner case therein, and the heat insulating layer is formed as a space between an outer periphery of the inner case and an inner periphery of the outer case.

The space is preferably made vacuous. It is also preferable to insert a heat insulator in the space.

An ink-jet recording apparatus of the present invention comprises an ink jet type recording head; and an ink tank for supplying ink to the recording head, a case body of the ink tank comprising an ink chamber containing the ink, an ink outlet formed on a bottom portion of the ink chamber, for letting the ink out of the ink chamber, and a heat insulating layer provided around the ink chamber, for insulating the ink chamber from external heat.

The present invention also suggest a method of manufacturing an ink tank for supplying ink to an ink jet type recording head, wherein the ink tank comprises a case body having an ink chamber containing the ink, and a heat insulating layer provided around the ink chamber for insulating against external heat, and a lid covering up an open top of the case body to close the ink chamber, the ink chamber being parted by a partition wall into an absorbent chamber containing at least an ink absorbent, and a storage chamber storing the ink to be absorbed by the ink absorbent, wherein the partition wall has an interconnection slot near a bottom of the ink chamber, to interconnect the storage chamber with the absorbent chamber, and the lid has an ink injection hole for injecting the ink in the storage chamber, and an air introduction hole for introducing air into the absorbent chamber, the method comprising steps of placing the ink absorbent in the absorbent chamber; injecting thereafter the ink in the absorbent chamber through the open top of the case body, to let the ink absorbent absorb the ink and fill the absorbent chamber with the ink; mounting thereafter the lid to the case body to close the ink chamber; injecting thereafter the ink in the storage chamber through the ink injection hole of the lid; stopping thereafter the ink injection hole with a stopper; and sticking thereafter a seal onto a top surface of the lid, to cover the ink injection hole and the air introduction hole.

Where the case body of the ink tank consists of an inner case having the ink chamber formed therein, and an outer case holding the inner case therein while providing a space between the cases to form a heat insulating layer, the inner case is placed in the outer case before mounting the lid to the case body.

It is preferable to carry out the step of mounting the lid to the case body in a vacuum. A step of inserting a heat insulator in the space may be carried out after the step of placing the inner case in the outer case and before the step of mounting the lid.

BRIEF DESCRIPTION OF THE DRAWINGS

The above and other objects and advantages will be more apparent from the following detailed description of the preferred embodiments when read in connection with the accompanied drawings, wherein like reference numerals designate like or corresponding parts throughout the several views, and wherein.

DESCRIPTION OF THE PREFERRED EMBODIMENTS

Figure 1:
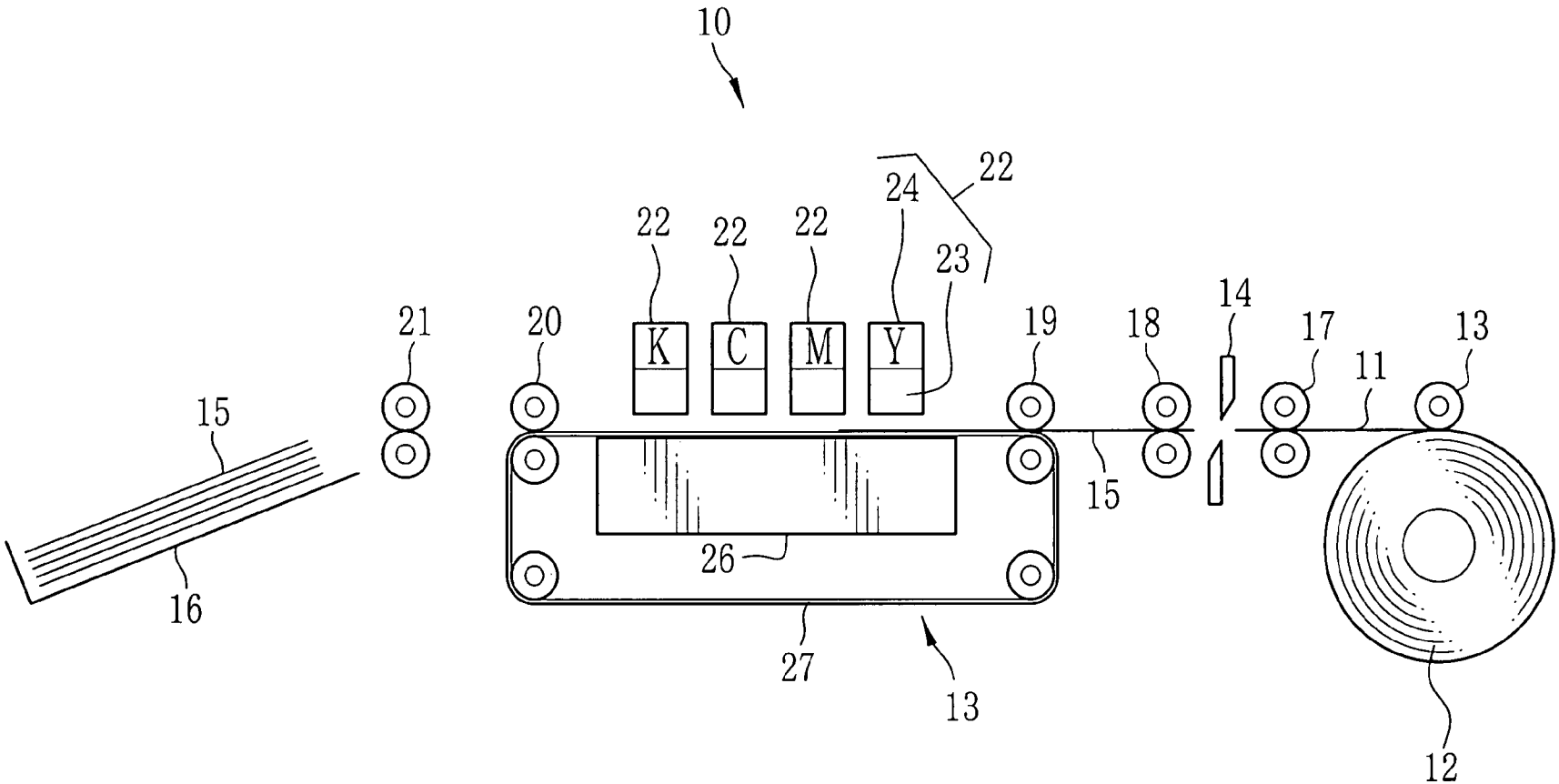
FIG. 1 is an explanatory diagram illustrating essential elements of an ink-jet recording apparatus according to an embodiment of the invention.

In an ink-jet recording apparatus 10 as shown in FIG. 1, a recording paper roll 12, which is formed by winding a long web of recording paper 11 around a spool, is placed such that paper feed-out rollers 13 draw the recording paper 11 out of the recording paper roll 12 into a transport path. A cutter 14 is disposed on the transport path, to cut the recording paper 11 into a sheet 15 of a given length. After an image is recorded on the paper sheet 15, the paper sheet 15 is ejected onto an ejection tray 16. On the transport path, there are also a number of pairs of conveyer rollers 17, 18, 19 and 20 for conveying the recording paper 11, and a pair of ejection rollers 21 for ejecting the paper sheet 15 onto the ejection tray 16. The paper feed-out rollers 13, the conveyer rollers 17 to 20 and the ejection rollers 21 are driven by a not-shown drive motor. The drive motor is for example a pulse motor, and a not-shown controller of the ink-jet recording apparatus 10 counts drive pulses of the pulse motor, to control conveying speed and amount of the recording paper 11.

A printing stage is provided on the transport path, where recording head units 22 are disposed for recording image frames of four colors: yellow (Y), magenta (M), cyan (C) and black (K), respectively. Each of the recording head units 22 consists of an ink jet type recording head 23 having a number of nozzles, and an ink tank 24 for supplying ink of one color to the recording head 23. The ink tank 24 is a cartridge that is removably attachable to the recording head unit 22.

Figure 3:
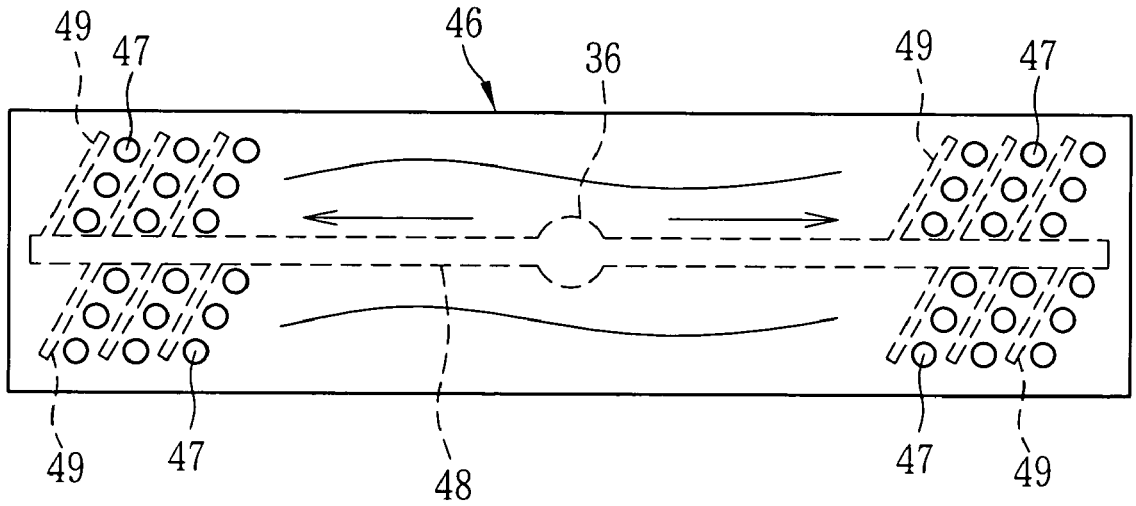
FIG. 3 is an explanatory diagram illustrating a discharge surface of a recording head of the recording head unit.

Outlets of the nozzles are arranged on a discharge surface 46 of the recording head 23, see FIG. 3, and the discharge surface 46 is elongated in a main scanning direction, to extend across the width of the recording paper 11. Thus, as shown, the discharge surface 46 has a length corresponding to the image width. As the recording paper 11 or the paper sheet 15 is conveyed in a sub scanning direction, the ink is discharged as droplets from at least one of the recording heads 23 onto the paper sheet 15, to record a line of image at a time. That is, the recording heads 23 are line recording heads. The recording head units 22 are positioned to oppose their discharge surfaces 46 to the paper sheet 15. A number of recording sheets 15 are successively fed along the transport path, so the recording heads 23 print images one after another on the recording sheets 15. The recording sheets 15 are conveyed in synchronism with the timing of recording by the recording head units 22. The paper sheet 15 having an image recorded thereon is ejected onto the ejection tray 16. Thus the printing is carried out at a high processing speed, while feeding a number of recording sheets successively along the transport path.

On the printing stage, a suction chamber 26 is placed in opposition to the respective recording head units 22. A porous belt 27 is laid between a sucking surface of the suction chamber 26 and the paper sheet 15, so that the suction chamber 26 sucks the paper sheet 15 through the porous belt 27. As being sucked from its back, the paper sheet 15 is kept at a constant clearance from the discharge surfaces 46 of the recording head units 22. The constant clearance ensures accuracy of landing positions of the ink droplets from the nozzles onto a front recording surface of the paper sheet 15. The suction chamber 26 also stabilizes the posture of the paper sheet 15 on the transport path, and thus prevents jamming of the paper sheet 15.

Figure 2:
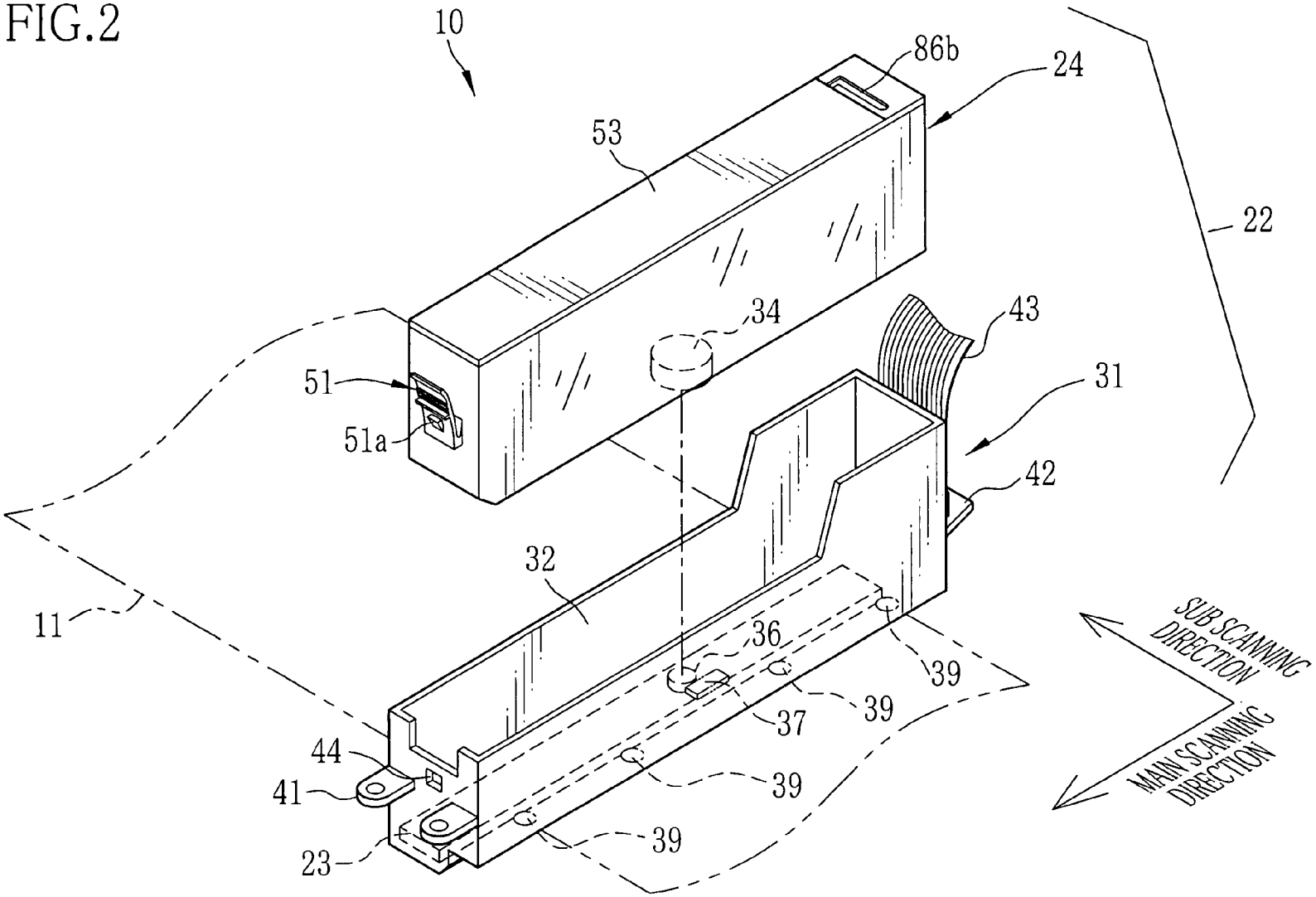
FIG. 2 is an exploded perspective view of a recording head unit used in the ink-jet recording apparatus of FIG. 1.

As shown in FIG. 2, the recording head unit 22 is provided with a head unit body 31, and the recording head 23 is mounted on a bottom of the head unit body 31. The ink tank 24 is loaded in a loading portion 32 of the head unit body 31, which is formed above the recording head 23. The loading portion 32 is provided with a joint port 36. The joint port 36 is fitted in an ink outlet 34 of the ink tank 24, which is formed on a bottom portion of the ink tank 24. The joint port 36 consists of a not-shown filter and an elastic ring surrounding the filter. When the joint port 36 is fitted in the ink outlet 34, an ink supply path from the ink tank 24 to the recording head 23 is established.

As shown for example in FIG. 3, the outlets 47 of the nozzles are arranged in six rows on the discharge surface 46, each row extending in the main scanning direction, and the outlets 47 of each row is staggered by a given amount from ones of adjacent rows, so that pixels are recorded at a high density in every image line, and thus the image is printed at a high resolution.

The ink is supplied from the ink outlet 34 to the joint port 36, and flows through an arterial channel 48 and branch channels 49 into the respective nozzles. The arterial channel 48 extends in the main scanning direction substantially along a lengthwise center line of the recording head 23. The branch channels 49 branch off from the arterial channel 48, and lead to the respective nozzles.

The joint port 36 is located at a position that substantially corresponds to a center point of the discharge surface 46. Since the discharge surface 46 of the line recording head is elongated, distances from the joint port 36 to the respective nozzles are relatively long. If the position of the joint port 36 were biased to one side in the lengthwise direction of the discharge surface 46, the distances from the joint port 36 to the nozzles on the other side would be longer. Then the ink could not evenly spread to the respective nozzles. Therefore, the joint port 36 is positioned at the center point in the lengthwise direction so as to equalize the distances from the joint port 36 to opposite ends of the discharge surface 46. Thus, differences between the distances from the joint port 36 to the respective nozzles are minimized, making it easier to feed the ink equally to the respective nozzles.

An ink run-out sensor 37 is disposed in the vicinity of the joint port 36, for checking if the ink remains in the ink tank 24. For example, the ink run-out sensor 37 is a reflective photo sensor consisting of a light emitting element and a light receiving element, wherein a light emitting surface and a light receiving surface are opposed to a bottom surface of the ink tank 24. The light emitting element emits light to the ink tank 24, and the light receiving element receives reflected light from the ink tank 24. The ink run-out sensor 37 outputs a signal whose level corresponds to the volume of the received light. Because the volume of the received light varies depending upon the residual amount of the ink, it is determined based on the signal level whether the ink remains in the ink tank 24 or not. It is alternatively possible to determine the residual amount of the ink in the ink tank 24.

The head unit body 31 further has on its bottom a paper width detector 39 for detecting the width of the recording paper 11 as being conveyed along the transport path. In the illustrated example, the paper width detector 39 consists of four reflective photo sensors which are arranged side by side in the widthwise direction of the recording paper 11, in order to discriminate between two sizes of paper width. If the recording paper 11 on the transport path has a wider width, all of the four photo sensors output detection signals. If the recording paper 11 on the transport path has a narrower width, central two of the four photo sensors alone output detection signals. Thus the difference in width of the recording paper is discriminated. The photo sensors of the paper width detector 39 are placed upstream of the discharge surface 46 of the recording head 23 in the sub scanning direction or the conveying direction of the recording paper 11. The paper width detector 39 may be used for detecting skew of the recording paper 11, that is, the paper sheet 15 in this embodiment.

On opposite ends of the head unit body 31 are provided mounting members 41 and 42 for securing the head unit body 31 to a chassis of the ink-jet recording apparatus 10. Besides, an end of a flexible cable 43 is connected to one end of the head unit body 31, so a drive signal is sent through the flexible cable 43 to the recording head 23 for controlling the recording head 23. An engaging hole 44 is formed through the other end of the head unit body 31. The engaging hole 44 is used for fastening the ink tank 24 to the head unit body 31 in the way as set forth below.

The ink tank 24 is substantially parallelepiped, and has a fastening member 51 on its one end. The fastening member 51 includes a ratchet 51*a* that engages in the engaging hole 44 of the head unit body 31 when the ink tank 24 is loaded in the loading portion 32. The fastening member 51 has a resiliency, so it enters the loading portion 32 while being deformed resiliently. When the ratchet 51*a* comes to face the engaging hole 44, the ratchet 51*a* snaps into the engaging hole 44 due to the resiliency, thereby fastening the ink tank 24 to the loading portion 32. A seal 53 is stuck onto a top surface of the ink tank 24, to cover most of an air introduction groove 86 that is formed in a top lid 62 of the ink tank 24, as set forth later with reference to FIG. 4. So only an end 86*b* of the air introduction groove 86 is exposed.

Figure 4:
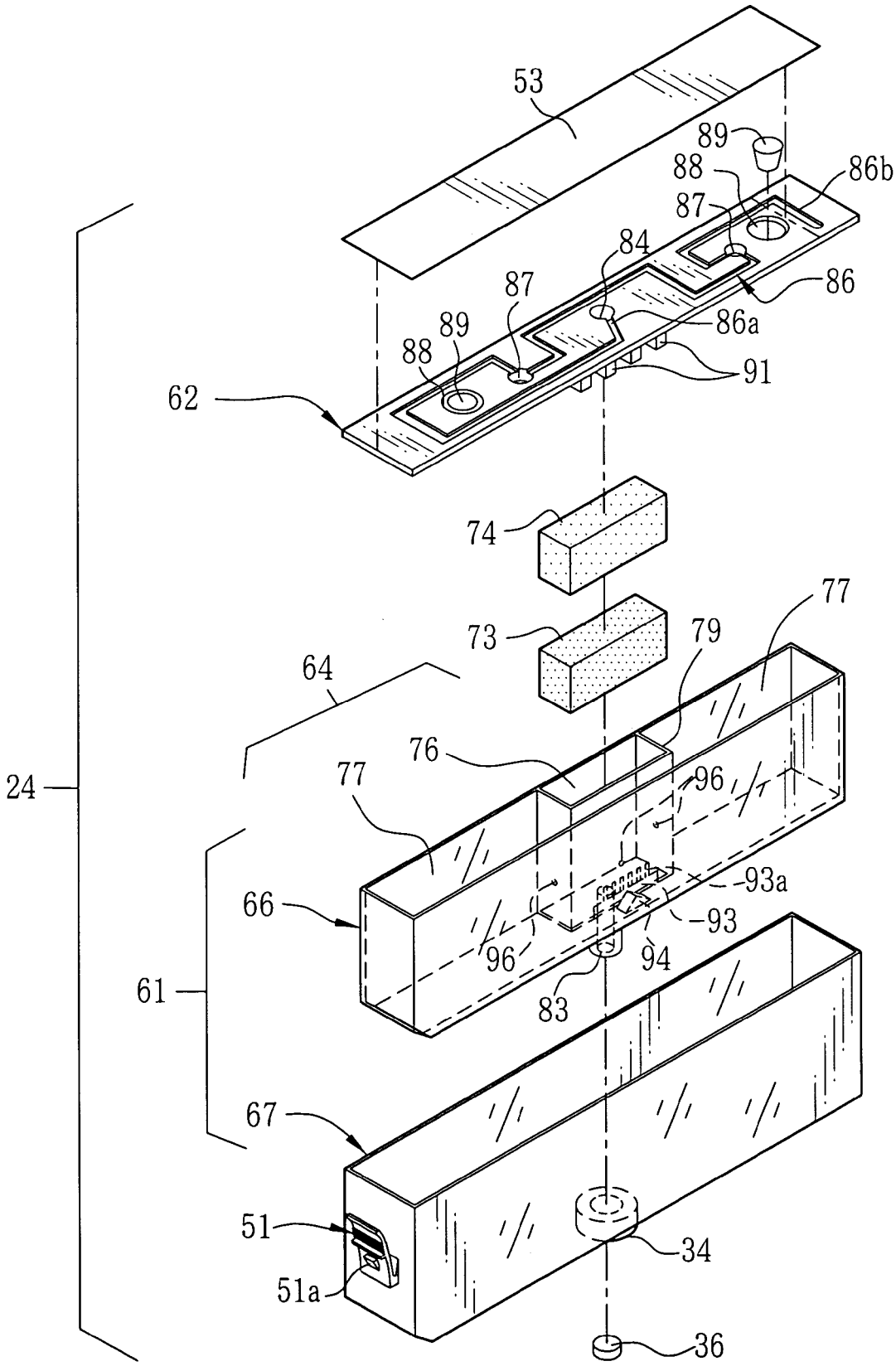
FIG. 4 is an exploded perspective view of an ink tank of the recording head unit.
Figure 5:
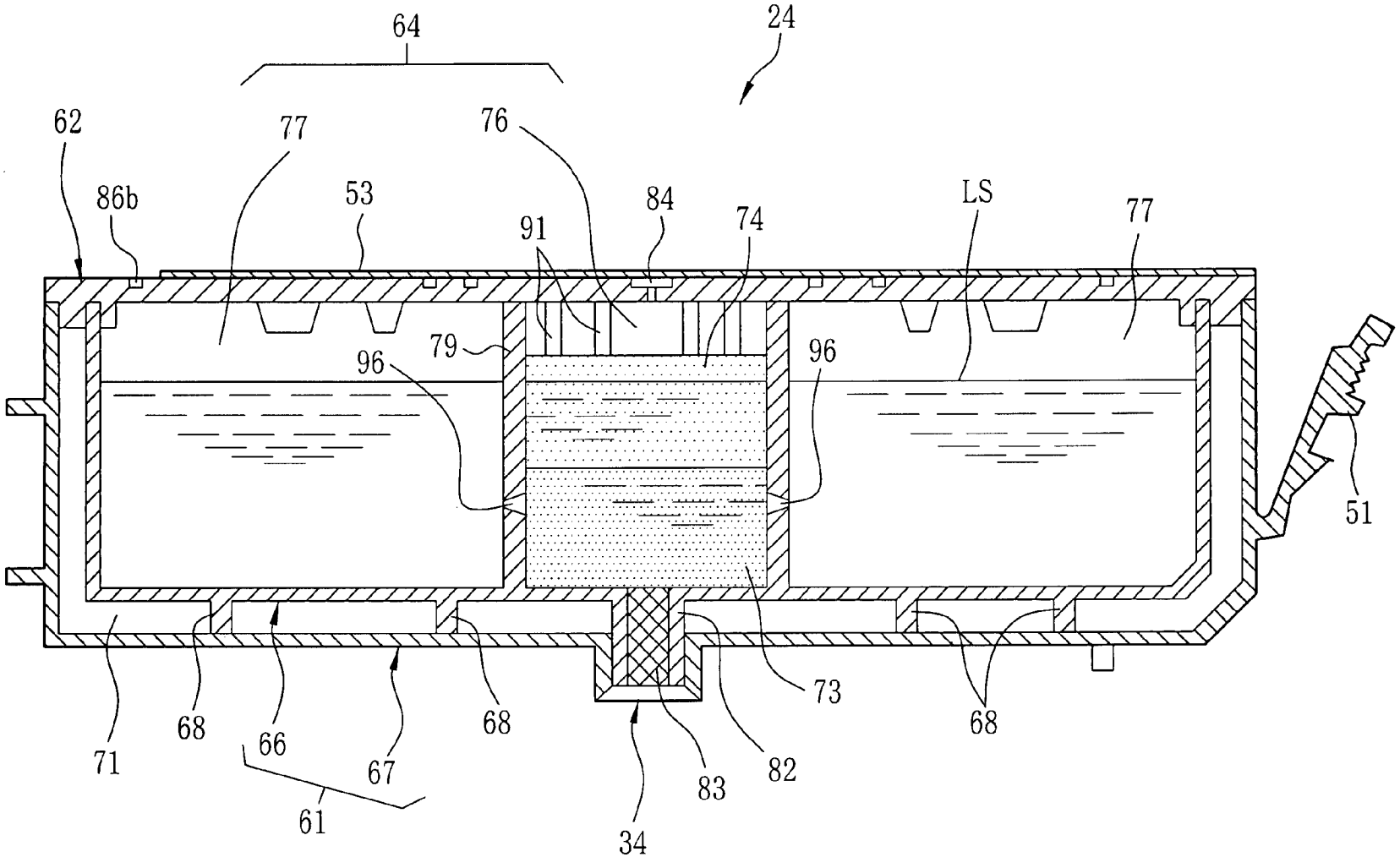
FIG. 5 is a sectional view of the ink tank taken substantially along a lengthwise center line.

As shown in FIGS. 4 and 5, the ink tank 24 consists of a case body 61 containing the ink and the top lid 62 closing an open top of the case body 61. The case body 61 consists of an inner case 66 in which an ink chamber 64 is formed, and an outer case 67 encasing the inner case 66. As seen in FIG. 4, the ink chamber 64 has a length substantially corresponding to the length of the line recording head 22. The inner case 66 has a smaller outer peripheral size than an inner peripheral size of the outer case 67. Ribs 68 are formed on an outer bottom surface of the inner case 66. The ribs 68 are in contact with an inner bottom surface of the outer case 67, so the outer bottom surface of the inner case 66 is spaced apart from the inner bottom surface of the outer case 67. Consequently, a space 71 is provided between the outer periphery of the inner case 66 and the inner periphery of the outer case 67 when the inner case 66 is held in the outer case 67.

The space 71 functions as a heat insulating layer that insulates the ink chamber 64 from external heat. Since the ink tank 24 is placed above the recording head 23 in the head unit body 31, a heat energy radiated from the recording head 23 can heat the ink stored in the ink chamber 64 of the ink tank 24. Because the recording head 23 as the line recording head has many nozzles, the heat energy generated from the nozzles increases correspondingly. As the ink is heated, viscosity of the ink changes, which may cause defective discharging or wasteful evaporation of the ink. Furthermore, an increase in temperature of the ink chamber 64 leads to raising the internal pressure of the ink chamber 64, which results in increasing the amount of oxygen dissolved in the ink. Then air bubbles are generated in the ink, which may cause defective discharging of the ink. Besides, the ink deteriorates due to chemical action of the dissolved oxygen on the ink.

In order to avoid the troubles as above, the space 71 is provided as the heat insulating layer around the ink chamber 64, to suppress the temperature increase of the ink caused by the heat energy radiated from the recording head 23. The space 71 is preferably made vacuous for the sake of preventing the air from permeating through the case body 61 into the ink chamber 64. It is also preferable to inject a heat insulator in the space 71. As the heat insulator, nitrogen gas or carbon dioxide gas is usable. As a liquid insulator, water or silicon oil may be injected in the space 71. A solid insulator, like urethane or silicone, is also usable.

The inner and outer cases 66 and 67 are made of a transparent plastic, so that the ink stored in the ink chamber 64 is visible from outside, to check the residual amount. As the plastic material, polypropylene is preferable because of its lightness and durability. The inner and outer cases 66 and 67 are manufactured in a resin molding method such as an injection molding using individual molds. As described later, the inner case 66 is sectioned by a partition wall into chambers. As having the complicated structure, the inner case 66 may be manufactured by forming the partition wall separately from peripheral walls, and bonding them afterward. Then, the molds for manufacturing the inner case 66 are simplified. But there is a risk in this method that an adhesive agent for bonding the walls can affect the ink badly. To avoid this problem, it is preferable to form the inner case 66 as an integral body, though a metal mold for the integral body is complicated. This method also reduces the requisite number of manufacturing processes and thus saves the time taken for manufacturing the inner case 66.

The ink chamber 64 of the inner case 66 consists of an absorbent chamber 76 holding first and second ink absorbents 73 and 74, and a storage chamber 77 storing the ink. The ink absorbents 73 and 74 absorb the ink from the storage chamber 77 and keep the ink inside them by their capillary force. The absorbent chamber 76 and the storage chamber 77 are parted by the partition wall 79. The absorbent chamber 76 is located in a middle portion of the inner case 66 in the lengthwise direction of the case 66. The storage chamber 77 has a channel shaped horizontal section, and borders three sides of the absorbent chamber 76. The absorbent chamber 76 has an ejection tube 82 formed through its bottom, and a filter 83 for filtering the ink is mounted in the ejection tube 82. The ejection tube 82 and the filter 83 constitute the ink outlet 34.

The first and second ink absorbents 73 and 74 are made of spongy materials with fine pores that generate capillary forces. Concretely, porous materials, including foamed materials such as urethane foam, and fibrous materials such as felt, may be used as the ink absorbents 73 and 74. Because of their capillary forces, the ink absorbents 73 and 74 function as negative pressure generating members that keep an internal pressure of the ink chamber 64 at a negative value relative to the atmosphere. When the ink tank 24 is loaded in the loading portion 32, the ink chamber 64 is connected to the recording head 23 through the ink supply path. Since the internal pressure of the ink chamber 64 is kept negative to the atmosphere, internal pressure in the nozzles of the recording head 23 is also kept negative to the atmosphere. Thereby, the ink is prevented from leaking out of the nozzles even though the recording head 23 is disposed below the ink tank 24.

The first and second ink absorbents 73 and 74 are laid atop another in the absorbent chamber 76, and are kept in tight contact with each other. The capillary force of the first ink absorbent 73, which is laid on the bottom of the absorbent chamber 76, is set higher than that of the second ink absorbent 74. Because of the higher capillary force of the first ink absorbent 73, the ink is prevented from leaking out of the absorbent chamber 76 through an air introduction hole 84 that is formed through the top lid 62 in a position over the absorbent chamber 76. If the ink tank 24 is inclined from its upright posture as shown in the drawings, the ink would flow from the absorbent chamber 76 to the top lid 62, and could leak through the air introduction hole 84. But the first ink absorbent 73, as having the higher capillary force than the second ink absorbent 74, absorbs the ink from the second ink absorbent 74, so the ink is hindered from flowing from the second ink absorbent 74 toward the air introduction hole 84. However, it is not always necessary to place the two kinds of ink absorbents, but it is possible to place a single ink absorbent in the absorbent chamber 76.

The top lid 62 is securely joined to the case body 61 for example by thermal welding, so that the ink contained in the case body 61 may not leak through the open top of the case body 61. The air introduction hole 84 introduces the air into the absorbent chamber 76 as the ink in the ink chamber 64 is consumed. The air introduction groove 86 is formed on a top of the top lid 62. The air introduction hole 84 is formed in one end 86*a* of the groove 86, and sinks 87 are formed at intermediate points of the groove 86 to the other end 86*b*. The air introduction groove 86 is covered with the seal 53, except but the end 86*b* is exposed, so that the air is introduced from the exposed end 86*b* through the groove 86 to the air introduction hole 84. When the ink tank 24 is shipped from the factory, the end 86*b* is also covered up with another seal. The user removes this seal to uncover the end 86*b* on loading the ink tank 24 in the head unit body 31.

The air introduction groove 86 conducts the ink to the sinks 87 when the ink leaks through the air introduction hole 84 out of the absorbent chamber 76, thereby to prevent the ink from leaking out of the ink tank 24, and also prevent drying the ink in the ink tank 24. The atmospheric air enters from the exposed end 86*b* and is conducted to the air introduction hole 84. Ink injection holes 88 are formed through the top lid 62, for injecting the ink into the ink chamber 64. After the ink is injected, the ink injection holes 88 are closed by stoppers 89.

A number of ribs 91 are formed on a bottom side of the top lid 62 in an area corresponding to the absorbent chamber 76. As the top lid 62 is mounted to the case body 61, the ribs 91 enter the absorbent chamber 76, and come into contact with a top side of the second ink absorbent 74, thereby pressing the second ink absorbent 74 onto the first ink absorbent 73. Thus, the second ink absorbent 74 is fixed in a position spaced apart from the top lid 62, and is prevented from displacing to close the air introduction hole 84.

During the printing, the recording head 23 generates such a suction force against the negative pressure of the ink chamber 64, that sucks the ink from the absorbent chamber 76 and causes the nozzles to discharge the ink from the outlets 47. As the recording head 23 sucks the ink, the pressure in the absorbent chamber 76 decreases, so the atmospheric air is introduced through the air introduction hole 84 into the absorbent chamber 76. An interconnection slot 93 is formed through a lower part of the partition wall 79, to interconnect the storage chamber 77 with the absorbent chamber 76. The ink in the ink chamber 64 is consumed first from a portion absorbed in the absorbent chamber 76, and the consumed amount of the ink is supplemented from the storage chamber 77 to the ink absorbent chamber 76 through the interconnection slot 93. As the ink stored in the storage chamber 77 decreases, the internal pressure of the storage chamber 77 decreases, so the air is taken into the storage chamber 77 through the interconnection slot 93. Repeating the above-described gas-liquid exchange in the ink tank 24, the ink is supplied from the ink tank 24 to the recording head 23.

Figure 6:
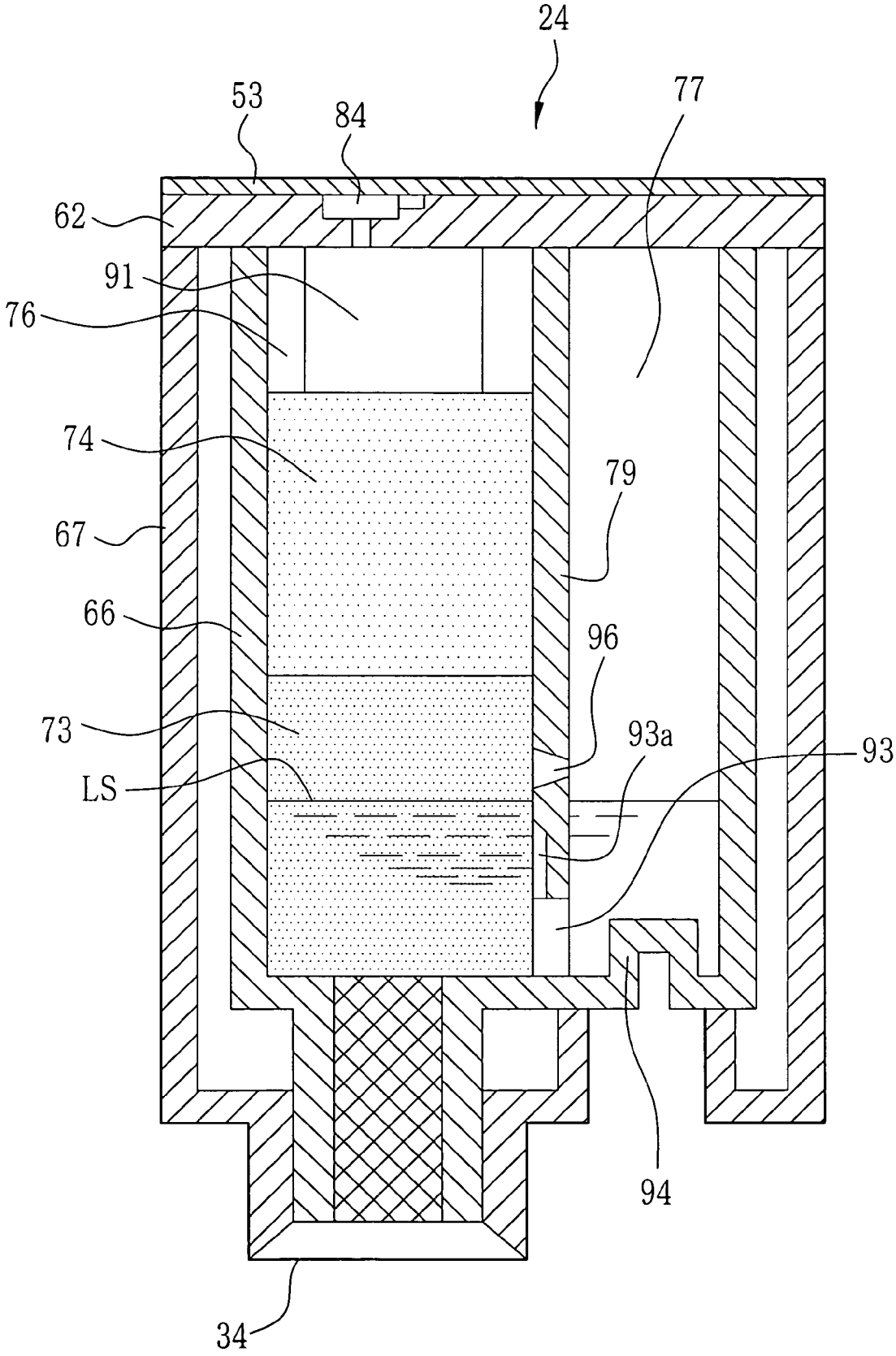
FIG. 6 is a sectional view of the ink tank taken substantially along a widthwise center line.

An ink detection prism 94 is formed on the inner bottom surface of the storage chamber 77 in the vicinity of the interconnection slot 93. A peak of the prism 94 protrudes upward from the inner bottom surface of the storage chamber 77. The ink run-out sensor 37 emits light from below the prism 94, and receives light reflected from the prism, to detect the ink optically. Based on the received light amount, the ink run-out sensor 37 may detect the residual amount of the ink, instead of detecting whether the ink remains or not. As shown in FIG. 6, a recess is formed on the bottom side of the prism 94. The recess prevents the prism 94 from distorting during the molding, and also prevents injurious diffusion light beams from falling on the light receiving element. The diffusion light beams cause noise in the detection signal.

As shown in FIGS. 4 and 6, air introduction grooves 93*a* are formed in the partition wall 79 above the interconnection slot 93 on the side of the absorbent chamber 76. The air introduction grooves 93*a* extend vertically, to form spaces between the first ink absorbent 73 and the absorbent chamber 76. So the air introduced into the absorbent chamber 76 is conducted through the air introduction grooves 93*a* into the interconnection slot 93. Thus the air introduction grooves 93*a* facilitates the gas-liquid exchange in the ink tank 24.

As the internal pressure of the storage chamber 77 decreases with the consumption of the ink stored therein, the air is introduced into the storage chamber 93 through the interconnection slot 93. However, because the interconnection slot 93 is formed near the bottom surface of the ink chamber 64, the air is not taken into the storage chamber 77 unless the pressure in the storage chamber 77 goes down to a certain level. When the pressure in the storage chamber 77 goes down to let the air into the storage chamber 77, the pressure in the storage chamber 77 begins to increase. If the amplitude of variation in the internal pressure of the storage chamber 77 becomes large, it can affect the sucking operation of the recording head 23 and make the discharging operation instable. The air introduction grooves 93*a* formed above the interconnection slot 93 contributes to reducing the amplitude of the pressure variation in the storage chamber 77 as caused by the gas-liquid exchange.

The partition wall 79 further has vent holes 96 in upper parts above the interconnection slot 93. Through the vent holes 96, the air is taken from the absorbent chamber 76 into the storage chamber 77, separately from the interconnection slot 93. The vent holes 96 are formed respectively through the three sides of the partition wall 79. Like the air introduction grooves 93*a*, the vent holes 96 are directed to reducing the amplitude of the pressure variation in the storage chamber 77. As being disposed above the interconnection slot 93, the vent holes 96 let the air into the storage chamber 77 before the pressure in the storage chamber 77 goes down to the certain level. Thus, the pressure variation is still more suppressed.

In a vertical direction of the ink tank 24, the vent holes 96 are preferably located around a border between the first and second ink absorbents 73 and 74. More preferably, the vent holes 96 are located in face to the first ink absorbent 73 near the border between the first and second ink absorbents 73 and 74. The vent holes 96 have conical inner peripheries so as to have a smaller diameter on the side of the storage chamber 77 than on the side of the absorbent chamber 76. This configuration facilitates introducing the air from the absorbent chamber 76 into the storage chamber 77.

Figure 7:
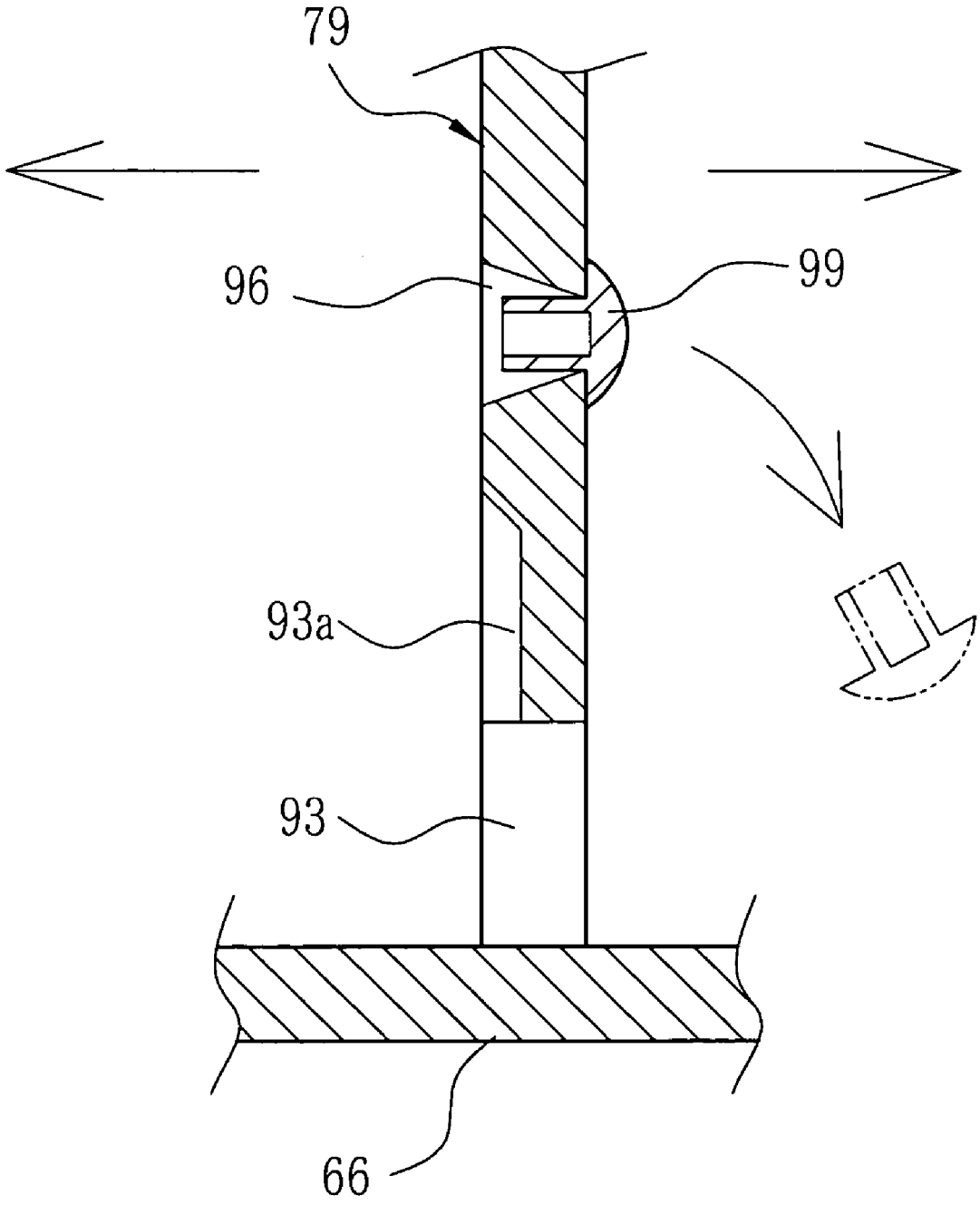
FIG. 7 is a fragmentary sectional view illustrating a vent hole formed through a partition wall of the ink tank, and a stopper for the vent hole.

It is possible to stop the vent holes 96 with stoppers 99, as shown in FIG. 7, when the ink tank 24 is shipped from the factory. Since the ink chamber 64 is filled with the ink before the ink tank 24 is loaded in the head unit body 31, the liquid surface LS of the ink is above the vent holes 96, as shown in FIG. 6. If the vent holes 96 are open in this condition, the gas-liquid exchange occurs through the vent holes 96 when the ink tank 24 leans while it is being handled. Then the ink flows from the storage chamber 77 to the absorbent chamber 76, and then to the top lid 62. The ink flowing into the top lid 62 can leak out through the air introduction hole 84. To avoid such trouble, the vent holes 99 are stopped with the stoppers 99. However, it is possible to omit the stoppers 99 if there is little risk that the gas-liquid exchange through the vent holes 96 causes leakage of the ink.

The stoppers 99 remove off the vent holes 96 when the pressure inside the storage chamber 77 goes down to a certain negative level. The vent holes 96 are thus opened by the time when the liquid surface LS of the ink goes down to a level corresponding to the vent holes 96. Instead of the stoppers 99 that are formed as pegs, the vent holes 96 may be stopped with another kind of stoppers, such as seals made of an ink solvable material, e.g. solid dye or solid pigment, or seals that automatically peel off when the pressure in the storage chamber 77 gets to a predetermined negative level.

Now the operation of the ink-jet recording apparatus will be described. Upon a print command, the recording paper 11 is drawn out from the recording paper roll 12, and the recording head unit 22 starts printing. The recording head 23 sucks the ink from the ink tank 24, and discharges the ink as droplets from the nozzle outlets 47 onto the recording paper 11, to record an image on the recording paper 11, that is cut into the paper sheet 15 in the illustrated embodiment. The longer the recording head 23 works, it radiates more heat energy, and the heat energy is transmitted to the ink tank 24 as disposed above the recording head 23. But the heat insulating layer 71 provided around the ink chamber 64 hinders the heat energy from heating the ink in the ink chamber 64. So the temperature and thus the viscosity of the ink vary less. Accordingly, the defective discharging of the ink or fluctuations in discharging amount of the ink, as caused by the change in viscosity of the ink, is suppressed. Also the wasteful evaporation of the ink is prevented.

The vent holes 96 are initially stopped with the stoppers 99. But when the residual amount of the ink in the storage chamber 77 decreases so much that the negative pressure inside the storage chamber 77 goes down to the predetermined negative level, the stoppers 99 automatically drop off due to the pressure difference between the storage chamber and the absorbent chamber. Then the air begins to enter the storage chamber 77 through the vent holes 96. Because the vent holes 96 are formed above the air introduction grooves 93*a* for the interconnection slot 93, the air is let into the storage chamber 77 through the vent holes 96 before the pressure in the storage chamber 77 goes down further to a more negative level. So the internal pressure of the storage chamber 77 varies less, and thus the discharging operation of the recording head 23 is stabilized.

Figure 8:
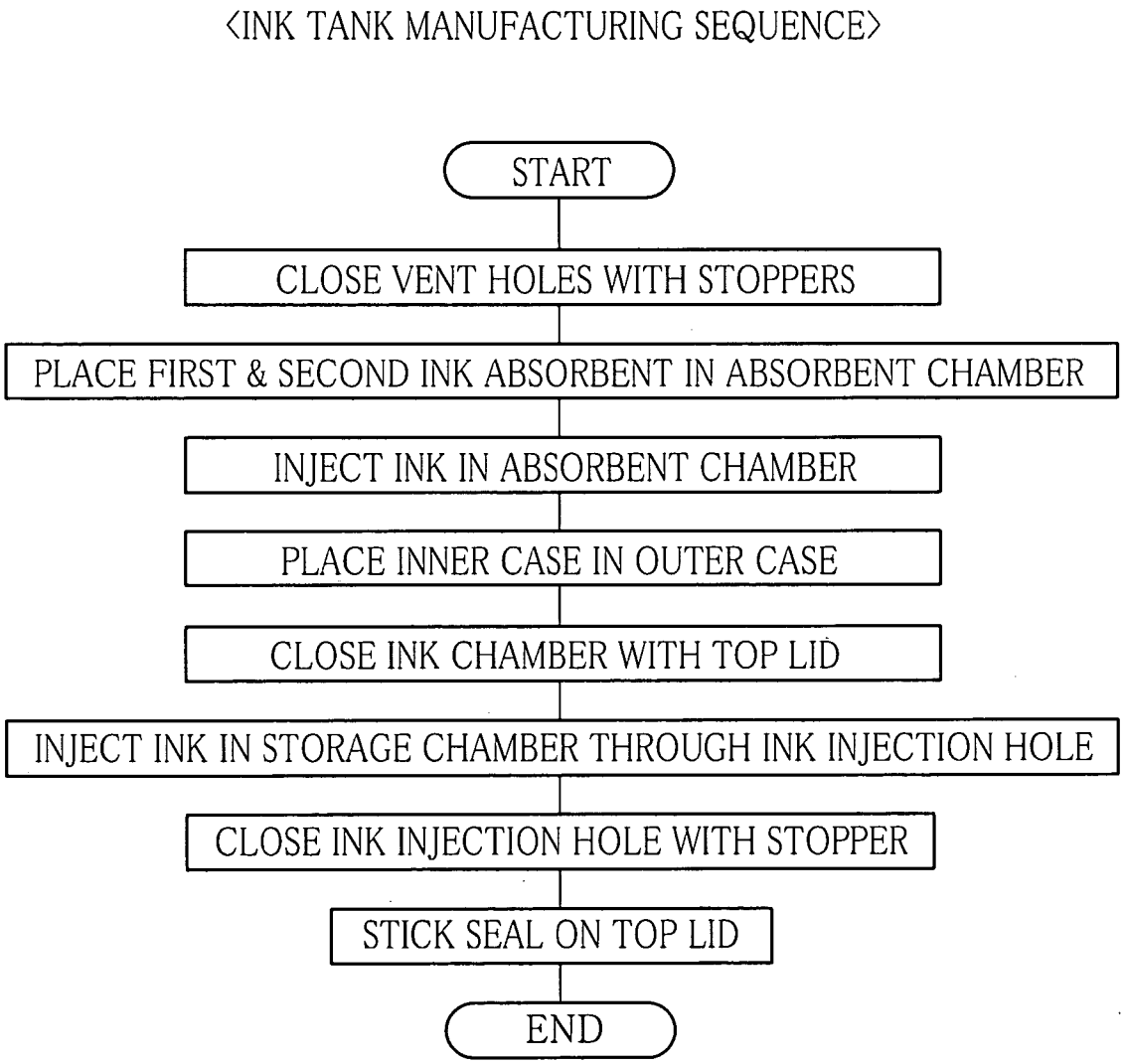
FIG. 8 is a flow chart illustrating a sequence of manufacturing the ink tank.

FIG. 8 shows a flow chart illustrating a sequence of manufacturing the ink tank 24. To assemble the ink tank 24, first the stoppers 99 are fitted in the vent holes 96 of the partition wall 79 of the inner case 66. Next, the first and second ink absorbents 73 and 74 are placed in the absorbent chamber 76. Thereafter, the ink is injected from the open top into the absorbent chamber 76, while letting the ink absorbents 73 and 74 absorb the ink. After the absorbent chamber 76 is filled with the ink, the inner case 66 is mounted in the outer case 67.

Then the top lid 62 is secured to the case body 61, to cover the ink chamber 64. To make the space 71 vacuous, the process of securing the top lid 62 is performed in a vacuum. If necessary, a heat insulator is inserted in the space 71 before the top lid 62 is secured. After the ink chamber 64 is covered with the top lid 62, the ink is injected through the ink injection holes 88 into the storage chamber 77. When the storage chamber 77 is filled with the ink, the ink injection holes 88 are stopped with the stoppers 89. Thereafter, the seal 53 is stuck onto the top surface of the top lid 62, completing the ink tank 24.

In the prevent embodiment, the ink tank is formed as a cartridge that is removably attachable to the head unit body. But it is possible to mount an ink tank fixedly to a head unit body, such that the ink tank is not removable from a recording head.

Although the above embodiment uses the line recording heads that records a line of image at a time, the present invention is applicable to a serial recording head that moves in the main scanning direction to record a line of image.

Thus the present invention is not to be limited to the above-described embodiments, but various modifications will be possible without departing from the scope of claims as appended hereto.

What is claimed is:

1. An ink tank for supplying ink to an ink jet type recording head comprising:

a case body having an ink chamber containing the ink, said ink chamber having an ink outlet formed on its bottom portion, for letting the ink out of said ink chamber; and a heat insulating layer provided around said ink chamber in said case body, for insulating said ink chamber from external heat, wherein said ink chamber comprises an absorbent chamber containing at least an ink absorbent that absorbs and holds the ink and generates a negative pressure in said absorbent chamber due to its capillary force, a storage chamber storing the ink to be absorbed by said ink absorbent, a partition wall partitioning said ink chamber into said absorbent chamber and said storage chamber, and an interconnection slot formed through said partition wall near a bottom of said ink chamber, to interconnect said storage chamber with said absorbent chamber, for exchanging the ink in the storage chamber with air that is introduced from outside said case body into said absorbent chamber, at least a vent hole is formed through said partition wall above said interconnection slot, for taking the air from said absorbent chamber into said storage chamber, and said vent hole is initially closed with a stopper, which is released by the time when a liquid surface of the ink goes down to said vent hole.

2. An ink tank as claimed in claim 1, wherein said stopper is removably fitted from said storage chamber into said vent hole, and removes from said vent hole due to a pressure decrease in said storage chamber, which results from consumption of the ink.

3. A method of manufacturing an ink tank for supplying ink to an ink jet type recording head, said ink tank comprising a case body having an ink chamber containing the ink, and a heat insulating layer provided around said ink chamber for insulating against external heat, and a lid covering up an open top of said case body to close said ink chamber, said ink chamber being parted by a partition wall into an absorbent chamber containing at least an ink absorbent, and a storage chamber storing the ink to be absorbed by said ink absorbent, wherein said partition wall has an interconnection slot near a bottom of said ink chamber, to interconnect said storage chamber with said absorbent chamber, and said lid has an ink injection hole for injecting the ink in said storage chamber, and an air introduction hole for introducing air into said absorbent chamber, said method comprising steps of:

placing said ink absorbent in said absorbent chamber;

injecting thereafter the ink in said absorbent chamber through said open top of said case body, to let said ink absorbent absorb the ink and fill said absorbent chamber with the ink;

mounting thereafter said lid to said case body to close said ink chamber;

injecting thereafter the ink in said storage chamber through said ink injection hole of said lid;

stopping thereafter said ink injection hole with a stopper; and sticking thereafter a seal onto a top surface of said lid, to cover said ink injection hole and said air introduction hole, wherein at least a vent hole is formed through said partition wall above said interconnection slot, for taking the air from said absorbent chamber into said storage chamber, said method further comprising a step of attaching a stopper to said vent hole before the step of injecting the ink in said absorbent chamber.

* * * * *